United States Patent [19]

Robinson

[11] Patent Number: 4,807,850

[45] Date of Patent: Feb. 28, 1989

[54] MULTI-VISCOSITY METERING VALVE

[75] Inventor: Edgar C. Robinson, Vancouver, Canada

[73] Assignee: International Thermal Research, Ltd., Richmond, Canada

[21] Appl. No.: 115,040

[22] Filed: Oct. 30, 1987

[51] Int. Cl.[4] ..... F16K 47/08; F16K 3/26; F16K 3/32

[52] U.S. Cl. ..... 251/206; 251/208; 137/637.4; 137/551

[58] Field of Search ..... 137/637.4, 551, 625.17; 251/205, 206, 208, 209

[56] References Cited

U.S. PATENT DOCUMENTS

| | | | |
|---|---|---|---|
| 324,151 | 8/1885 | Panzig | 137/637.4 |
| 1,841,224 | 1/1932 | Thomson | 137/637.4 |
| 2,642,254 | 6/1953 | Armstrong | 251/205 X |
| 3,213,888 | 10/1965 | Cameron et al. | 137/637.4 |
| 4,144,904 | 3/1979 | Dits | 251/206 X |

FOREIGN PATENT DOCUMENTS

| | | | |
|---|---|---|---|
| 412827 | 5/1910 | France | 251/209 |

*Primary Examiner*—Arnold Rosenthal
*Attorney, Agent, or Firm*—John R. Uren

[57] ABSTRACT

A multi-viscosity fuel metering valve comprises a metering stem and a metering stem guide. The metering stem is rotatable relative to the metering stem guide. A port is located in the metering stem guide and a plurality of orifices, each having different dimensions, are positioned in the metering stem. The port in the metering stem guide may be moved relative to each of the orifices and each of the orifices may be individually positioned adjacent the port. The selection of an orifice for a fuel having a particular viscosity allows the use of different fuels with a heating apparatus such as a burner.

13 Claims, 2 Drawing Sheets

MULTI-VISCOSITY METERING VALVE

INTRODUCTION

This invention relates to a multi-viscosity fuel metering valve and, more particularly, to a multi-viscosity fuel metering valve for a burner intended to be utilized with one of several different fuels.

BACKGROUND OF THE INVENTION

In heating apparatuses such as stoves, burners and the like and particularly with such apparatuses that are portable and intended to be used in a variety of circumstances in different locations, the ability to use any fuel that may be available, such as diesel fuel, jet fuel and gasoline, is desirable. Such a capability will increase the adaptability of the heating apparatus. Furthermore, since the viscosity of even the same fuel can vary, it is desirable to have the ability to adjust the heating apparatus to allow for the different flow characteristics caused by the change in viscosity.

Previously, valves were utilized which had one orifice through which all of the various fuels would flow. Using different fuels would increase or decrease the flow rate with the result that the burner to which the fuel was provided would be over-fired or under-fired. Over-firing could result in excessive heat thereby creating a safety hazard. Under-firing could cause the burner to carbon up which adversely affects burner performance.

SUMMARY OF THE INVENTION

According to the invention, there is provided a multi-viscosity fuel metering valve comprising at least two orifices located in a first member, a port positioned in a second member, means to position one of said first or second members such that each of said orifices may be individually located adjacent said port and means to move the other of said first and second members such that the area of said port exposed to each individual orifice may be varied.

According to a further aspect of the invention, there is provided a multi-viscosity metering valve comprising a metering stem positioned adjacent to a metering stem guide, a plurality of orifices in one of said metering stem or said metering stem guide, each of said orifices being operable to be positioned adjacent a port located in the other of said metering stem or said metering stem guide, the flow area of each of said orifices being adjustable by relative movement of one of said orifice or said port relative to the other of said orifice or said port.

BRIEF DESCRIPTION OF THE SEVERAL VIEWS OF THE DRAWINGS

A specific embodiment of the invention will now be described, by way of example only, with the use of drawings in which.

DESCRIPTION OF SPECIFIC EMBODIMENT

Figure 1:
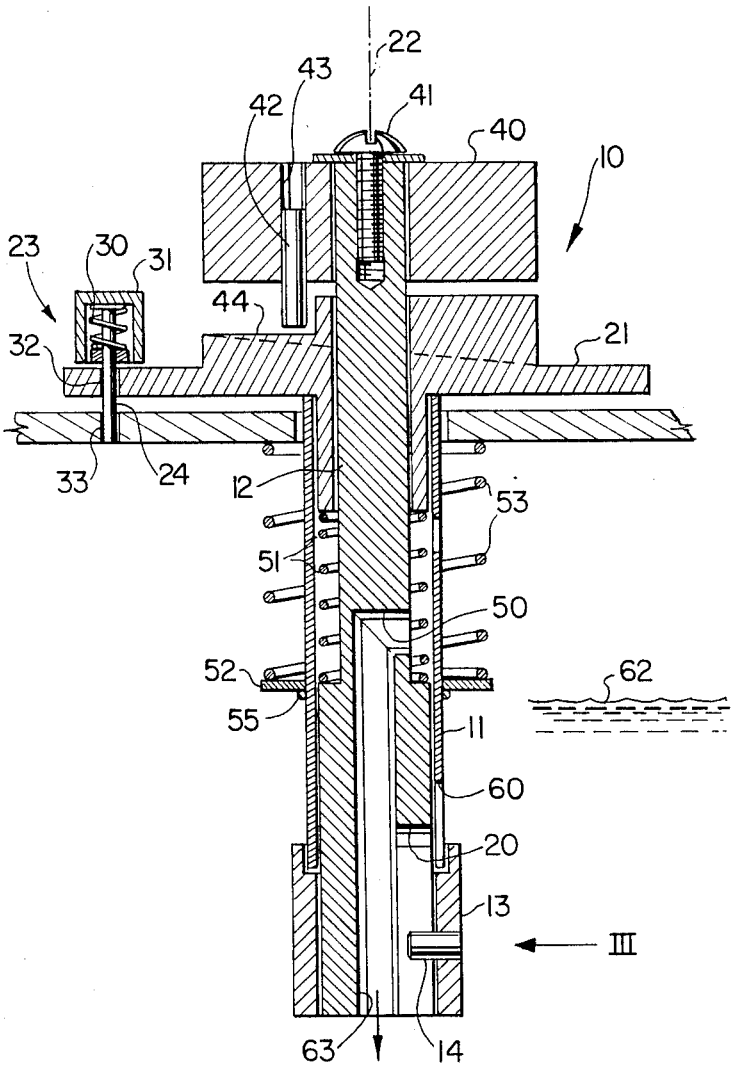
FIG. 1 is a sectional view of the multi-viscosity fuel metering valve according to the invention.

Referring now to the drawings, a multi-viscosity fuel metering valve is illustrated generally at 10 in FIG. 1. It comprises a metering stem 11 and a metering stem guide 12 longitudinally movable and positioned within a metering stem seat 13. A pin 14 is mounted on the metering stem seat 13, the pin 14 being operable to be positioned within a longitudinal port 20 in the metering stem guide 12 such that the metering stem guide 12 can move axially up and down relative to the pin 14.

The metering stem 11 is connected at its upper end to a metering stem plate 21. The metering stem 11 is rotatable with the metering stem plate 21 about the axis 22 of the metering stem 11 and the metering stem guide 12.

A fuel selector knob assembly generally shown at 23 is connected to the metering stem plate 21. It comprises a pin 24 biased downwardly by compression spring 30, both the pin 24 and the spring 30 being mounted within knob 31. A hole 32 in the metering stem plate 21 allows for suitable movement of pin 24 and three complementary holes 33, only one of which is shown in FIG. 1, are mounted equidistantly about axis 22 in the valve cover plate 34. Each hole 33 is operable to receive pin 24, the hole 33 into which pin 24 is inserted depending upon the fuel intended to be used with the metering valve 10.

The metering stem guide 12 extends through and is connected at its upper end to a metering stem knob 40 by a suitable connection means such as bolt 41. Bolt 41 allows rotation of the metering stem knob 40 relative to the metering stem guide 12. A pin 42 is mounted in a hole 43 in metering stem knob 40 and extends downwardly a distance from the bottom of metering stem knob 40 to a cam surface 44 machined on the metering stem plate 21.

The port 20 in metering stem guide 12 extends from the area open to the side of metering stem guide 12 to an opening 50 located above the level of the fuel held by the valve 10 when in operating condition. A compression spring 51 is mounted between the metering stem plate 21 and the metering stem guide 12 and acts to bias the metering stem guide 12 downwardly such that pin 42 contacts the cam surface 44 on the metering stem plate 21.

A washer 52 is mounted on the metering stem 11 by use of a retaining ring 55. A compression spring 53 is mounted around metering stem 11 between washer 52 and the valve cover plate 34. Compression spring 53 is operable to bias the metering stem 11 downwardly in the metering stem seat 13.

Figure 3:
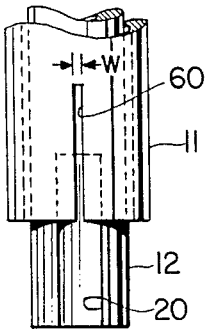
FIG. 3 is an enlarged partial view of the port of the metering stem and the orifice of the metering stem guide in operating relationship taken along the view line III of FIG. 1.
Figure 4:
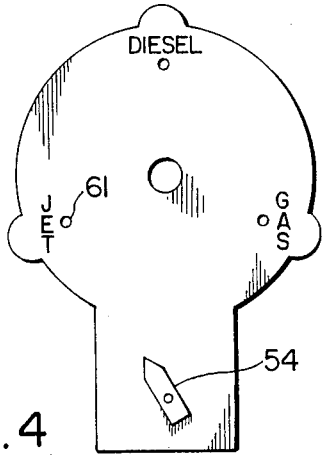
FIG. 4 is a plan view of the valve cover plate.

Three orifices 60, only one of which is shown in FIG. 1, are positioned in the metering stem 11. Each orifice 60 has a generally rectangular configuration as illustrated in FIG. 3. The length of each orifice 60 in metering stem 11 is the same but the width W of each orifice 60 varies depending on which fuel is designed to flow through the particular orifice 60. For example, if is intended to use gasoline with one orifice and diesel fuel with a second orifice, the width of the orifice used for gasoline will be narrower than the width of the orifice used with diesel fuel.

Figure 2:
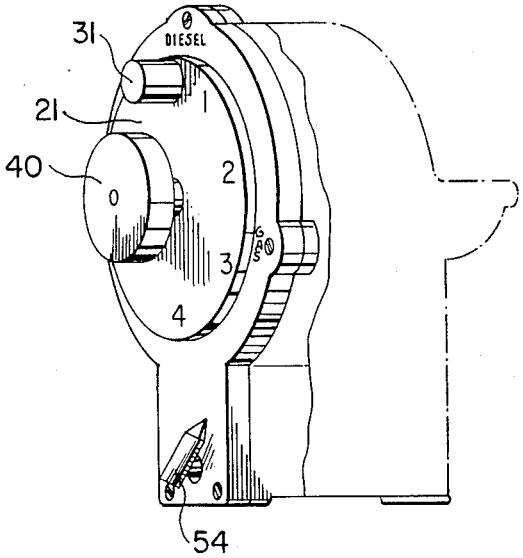
FIG. 2 is a diagrammatic plan view of the valve principally illustrating the valve cover plate.

A fuel shut off knob 54 (FIG. 2) is mounted on and is rotatable relative to the valve cover plate 34. The fuel shut off knob 54 is operably connected to the float (not shown) within the float chamber of the metering valve 10. The float allows for the ingress of fuel from the fuel source (not shown) into the float chamber and the fuel shut off knob 54 simply controls the commencement and termination of fuel flow into the float chamber. Such a float apparatus and fuel shut off knob 54 are well known in the art and form no part of the present invention.

OPERATION

In operation, it will be assumed that the fuel available is jet fuel and it is intended to use such fuel with a burner to which the valve 10 is operably connected.

The operator will initially pull the knob 31 of the fuel selector knob assembly 23 in order to remove pin 24 from the hole 33 in the valve cover plate 33. He will rotate the metering stem plate 21 relative to the valve cover plate 34 until, pin 24 is located above the jet fuel hole 60 (FIG. 3). Knob 31 is released and pin 24 enters hole 60 to secure the metering stem plate 21 relative to the valve cover plate 34.

As the metering stem plate 21 is rotated relative to the valve cover 34, the metering stem 11 connected to the metering stem plate 21 is also rotated relative to the metering stem guide 12. The jet fuel hole 60 and the hole 33 which could be assigned to, say, gasoline, are positioned such that when the pin 24 enters the correct hole, the appropriate orifice is positioned adjacent or over the port 20 as viewed in FIG. 3.

As the metering stem 11 is being rotated, the metering stem guide 12 will be stationary due to the pin 14 extending from the metering stem seat 13 into the longitudinal port 20.

The operator will then turn on the fuel shut off knob 54 allowing fuel to enter the float chamber. The fuel level will rise and be maintained by the float, such that the surface 62 of the fuel shown diagrammatically in FIG. 1 is not higher than the level of the opening 50.

The operator may adjust the flow rate of the fuel through orifice 60 into port 20 which then exits the valve 10 at outlet 63 and passes to the burner (not shown) by rotating metering stem knob 40. As the knob 40 rotates, the pin 42 which is riding on cam surface 44 will move up or down depending on whether the knob 40 is rotated clockwise or counterclockwise. Assuming the knob 40 is rotated clockwise and the cam surface 44 increases in height as the knob 40 is rotated, the port 20 will move axially upwardly thus allowing more area to be exposed to the flow through orifice 60 and thereby allowing the flow to increase for each increment of rotation of the knob 40. Thus, the appropriate flow rate for each fuel may be obtained for the burner conditions desired.

Many modifications to the specific embodiments described may readily occur to those skilled in the art. For example, the orifices 60 may be positioned in the metering stem guide 12 rather than the metering stem 11 and the port 20 could be positioned in the metering stem 11. The metering stem 11 could move axially rather than being rotatable and the metering stem guide 12 could be rotatably movable relative to the metering stem 11. The orifices 60 need not be longitudinal in configuration although such configuration is desirable because of the linear flow characteristics. Rather, the orifice could assume any shape which would allow each orifice to pass fuel at a rate satisfactory for the particular fuel for which each was designed. In respect of the port 20, the metering stem guide 12 need not be axially movable relative to the orifices 60. It need merely expose more area to the orifice 60 depending on the flow rate desired by the operator.

Similarly, while three orifices have been described, each one to be used with one of jet fuel, diesel fuel or gasoline, clearly either a greater or lesser number of orifices could be provided depending upon the uses under which it is desired to use the burner and the valve. It should also be clear that the valve may be used with a plurality of fuels, each of the fuels having a range of viscosities depending on the source of the fuel and the conditions under which the fuel was refined. Thus, a specific heating oil can be used satisfactorily even when the viscosity of the particular fuel varies over time. For example, the viscosity range in kinematic centistokes for diesel fuel varies from 1.6 to 4.28 while the typical product supplied by Shell Oil has a viscosity of 3.7. A 25% variation in fuel viscosity is normal. Thus, two or even three orifices may be used for a single fuel depending on the viscosity range.

Many modifications additional to those set out above will readily occur to those skilled in the art and the specific embodiments described herein should be considered illustrative of the invention only and not as limiting its scope which should be construed in accordance with the accompanying claims.

I claim:

1. A multi-viscosity fuel metering valve comprising at least two orifices having different dimensions located in a first member, a port positioned in a second member, means to position one of said first or second members such that each of said orifices may be individually located adjacent said port and means to move the other of said first and second members such that the area of said port exposed to each individual orifice may be varied.

2. A fuel metering valve as in claim 1 wherein said first member is a metering stem and said second member is a metering stem guide.

3. A fuel metering valve as in claim 2 wherein said metering stem guide is circumferentially surrounded by said metering stem.

4. A fuel metering valve as in claim 3 wherein said metering stem guide is axially movable relative to said metering stem and said metering stem is rotatable relative to said metering stem guide.

5. A fuel metering valve as in claim 4 wherein said orifices and said port are substantially rectangular.

6. A fuel metering valve as in claim 5 wherein the length of each of said orifices is substantially identical and the width of each of said orifices varies.

7. A multi-viscosity metering valve comprising a metering stem positioned adjacent to a metering stem guide, a plurality of orifices in one of said metering stem or said metering stem guide each of said orifices having a different dimension and being operable to be positioned adjacent a port located in the other of said metering stem or said metering stem guide, the flow area of each of said orifices being adjustable by relative movement of one of said orifice or said port relative to the other of said orifice or said port.

8. A fuel metering valve as in claim 7 and further comprising positioning means to position one of said orifices or said port adjacent the other of said orifices or said port.

9. A fuel metering valve as in claim 7 wherein said plurality of orifices are located in said metering stem and said port is located in said metering stem guide.

10. A multi-viscosity metering valve as in claim 9 wherein said positioning means positions said orifices relative to said port.

11. A multi-viscosity metering valve as in claim 8 wherein said positioning means positions said orifices relative to said port.

12. A multi-viscosity metering valve as in claim 2 wherein each of said orifices has a width and a length and said flow area of each of said orifices is varied by changing the length of said orifice relative to said port.

13. A multi-viscosity metering valve as in claim 8 wherein said positioning means is connected to said metering stem.

* * * * *